US007406818B2

(12) United States Patent
Keith

(10) Patent No.: US 7,406,818 B2
(45) Date of Patent: Aug. 5, 2008

(54) YARN MANUFACTURING APPARATUS AND METHOD

(75) Inventor: Kenneth H. Keith, Chatsworth, GA (US)

(73) Assignee: Columbia Insurance Company, Omaha, NE (US)

( * ) Notice: Subject to any disclaimer, the term of this patent is extended or adjusted under 35 U.S.C. 154(b) by 345 days.

(21) Appl. No.: 10/985,269

(22) Filed: Nov. 10, 2004

(65) Prior Publication Data

US 2006/0096270 A1 May 11, 2006

(51) Int. Cl.
*D01H 7/92* (2006.01)

(52) U.S. Cl. ..... 57/332; 57/344

(58) Field of Classification Search ..... 57/332–334, 57/341, 344; 28/271
See application file for complete search history.

(56) References Cited

U.S. PATENT DOCUMENTS

| | | | | |
|---|---|---|---|---|
| 3,115,691 | A | 12/1963 | Bunting, Jr. et al. | |
| 3,262,179 | A | 7/1966 | Sparling | |
| 3,278,164 | A | 10/1966 | Breen et al. | |
| 3,443,292 | A | 5/1969 | Davis | |
| 3,483,691 | A | 12/1969 | Williams et al. | |
| 3,537,248 | A | 11/1970 | Berg et al. | |
| 3,659,350 | A | 5/1972 | McCullough | 34/155 |
| 3,730,413 | A | 5/1973 | McDermott et al. | 226/97 |
| 3,751,775 | A | 8/1973 | Psaras | 28/1.4 |
| 3,828,404 | A | 8/1974 | Peckinpaugh et al. | 28/1.4 |
| 3,843,098 | A | 10/1974 | Phillips et al. | 259/4 |
| 3,858,387 | A | 1/1975 | Baliga et al. | 57/140 R |
| 3,936,999 | A | 2/1976 | Ikeda et al. | 57/157 |
| 4,068,358 | A | 1/1978 | Luther | 28/272 |
| 4,138,840 | A | 2/1979 | Greenway et al. | 57/289 |
| 4,156,071 | A | 5/1979 | Knox | 528/272 |
| 4,223,520 | A | 9/1980 | Whitted et al. | 57/350 |
| 4,297,837 | A | 11/1981 | Bauer et al. | 57/350 |
| 4,377,932 | A | 3/1983 | Dammann et al. | 57/336 |
| 4,406,850 | A | 9/1983 | Hills | 264/171 |
| 4,570,312 | A | 2/1986 | Whitener, Jr. | 28/271 |
| 4,633,550 | A | 1/1987 | McAliley et al. | 28/272 |
| 4,639,986 | A | 2/1987 | Borenstein | 28/272 |
| 4,644,622 | A | 2/1987 | Bauer et al. | 28/271 |
| 4,698,260 | A | 10/1987 | Sasaki et al. | 428/399 |
| 4,712,366 | A | 12/1987 | Tsujimoto et al. | 57/245 |
| 4,715,097 | A | 12/1987 | Bogucki-Land | 28/172 |
| 4,717,325 | A | 1/1988 | Fujimura et al. | 425/131.5 |
| 4,768,857 | A | 9/1988 | Sakunaga et al. | 350/96.24 |
| 4,782,565 | A | 11/1988 | Sheehan et al. | 28/248 |

(Continued)

FOREIGN PATENT DOCUMENTS

| | | |
|---|---|---|
| EP | 0128013 | 12/1984 |

(Continued)

*Primary Examiner*—Shaun R Hurley
(74) *Attorney, Agent, or Firm*—Needle & Rosenberg, P.C.

(57) ABSTRACT

The present invention is an apparatus and method of making yarn for carpet that exhibits a high degree of color pop. More specifically, in one aspect, the present invention comprises an apparatus and method that comprises supplying a plurality of yarns, false-twist the plurality of yarns, and passing the consolidated yarn through a downstream entangling assembly to tack at least a portion of the consolidated yarn. Another aspect of the present invention passes at least one of the plurality of yarns through one of a plurality of second entangling assemblies positioned upstream of the false-twist apparatus.

23 Claims, 3 Drawing Sheets

U.S. PATENT DOCUMENTS

| | | | | |
|---|---|---|---|---|
| 4,785,616 | A | 11/1988 | Heywood | 57/7 |
| 4,813,223 | A | 3/1989 | Nipper et al. | 57/294 |
| 4,852,341 | A | 8/1989 | Kato et al. | 57/328 |
| 4,999,891 | A | 3/1991 | Bankar | 28/272 |
| 5,091,130 | A | 2/1992 | Bahia | 264/103 |
| 5,136,835 | A | 8/1992 | Hirao | 57/285 |
| 5,307,616 | A * | 5/1994 | Goineau et al. | 57/284 |
| 5,307,617 | A | 5/1994 | Karhu | 57/293 |
| 5,404,706 | A | 4/1995 | Ueno et al. | 57/290 |
| 5,456,070 | A | 10/1995 | Lin et al. | 57/48.61 |
| 5,462,790 | A | 10/1995 | Matsuki et al. | 428/229 |
| 5,468,555 | A | 11/1995 | Lijten et al. | 428/365 |
| 5,532,060 | A | 7/1996 | Aneja et al. | 428/398 |
| 5,618,479 | A | 4/1997 | Lijten et al. | 264/103 |
| 5,715,584 | A | 2/1998 | Coons, III et al. | 28/140 |
| 5,746,046 | A | 5/1998 | McCartney et al. | 57/350 |
| 6,029,328 | A | 2/2000 | Ballarati | 28/271 |
| 6,052,878 | A | 4/2000 | Allred et al. | 28/274 |
| 6,052,983 | A | 4/2000 | Moran et al. | 57/293 |
| 6,089,009 | A | 7/2000 | Hand et al. | 57/282 |
| 6,119,320 | A * | 9/2000 | Weiss | 28/221 |
| 6,195,975 | B1 | 3/2001 | Hand et al. | 57/293 |
| 6,332,253 | B1 | 12/2001 | Rasnick, Jr. et al. | 28/258 |
| 6,378,283 | B1 | 4/2002 | Barton | 57/58.52 |
| 6,399,194 | B1 * | 6/2002 | Kunisada et al. | 428/357 |
| 6,438,812 | B1 | 8/2002 | Jansen | 28/274 |
| 6,454,975 | B1 | 9/2002 | O'Mara, Jr. et al. | 264/78 |
| 6,536,199 | B2 | 3/2003 | Wortmann et al. | 57/264 |
| 6,562,456 | B1 | 5/2003 | Bruner et al. | 428/364 |
| 6,701,703 | B2 | 3/2004 | Patrick | 57/229 |
| 6,722,117 | B2 | 4/2004 | Belcher, Jr. et al. | 57/205 |
| 6,723,265 | B1 | 4/2004 | Osaka et al. | 264/103 |
| 6,880,320 | B2 * | 4/2005 | Olinger et al. | 57/228 |
| 2002/0029554 | A1 * | 3/2002 | Belcher et al. | 57/333 |
| 2003/0110754 | A1 | 6/2003 | Simmen | |
| 2004/0096621 | A1 | 5/2004 | Dai et al. | 428/97 |
| 2004/0107553 | A1 * | 6/2004 | Goineau et al. | 28/219 |
| 2005/0022493 | A1 * | 2/2005 | Olinger et al. | 57/228 |
| 2005/0158543 | A1 * | 7/2005 | Lee et al. | 428/373 |

FOREIGN PATENT DOCUMENTS

| | | | |
|---|---|---|---|
| EP | 0434448 | | 6/1991 |
| EP | 0447549 | | 9/1991 |
| EP | 0579866 | | 1/1994 |
| EP | 0596431 | | 5/1994 |
| EP | 0930383 | | 7/1999 |
| EP | 1207226 | | 5/2002 |
| GB | 2372512 | | 8/2002 |
| JP | 56091016 | | 7/1981 |
| JP | 59179830 | | 10/1984 |
| JP | 61028016 | | 2/1986 |
| JP | 61258019 | | 11/1986 |
| JP | 2047322 | | 2/1990 |
| JP | 2080631 | | 3/1990 |
| JP | 03027107 | | 2/1991 |
| JP | 03113010 | | 5/1991 |
| JP | 3249231 | | 11/1991 |
| JP | 04194012 | | 7/1992 |
| JP | 5247757 | | 9/1993 |
| JP | 06257009 | | 9/1994 |
| JP | 06287815 | | 10/1994 |
| JP | 07216630 | | 8/1995 |
| JP | 07310225 | | 11/1995 |
| JP | 08060427 | | 3/1996 |
| JP | 09049115 | | 2/1997 |
| JP | 10266011 | | 10/1998 |
| JP | 10266013 | | 10/1998 |
| JP | 2001011741 | | 1/2001 |
| JP | 2001011743 | | 1/2001 |
| JP | 2001371236 | | 10/2001 |
| JP | 2001336039 | | 12/2001 |
| JP | 2002054046 | | 2/2002 |
| JP | 2002069763 | | 3/2002 |
| JP | 2002069768 | | 3/2002 |
| JP | 2002266153 | | 9/2002 |
| WO | WO 03029538 | | 4/2003 |
| WO | WO-03087447 | A1 * | 10/2003 |
| WO | WO 03091485 | | 11/2003 |
| WO | WO 2004057074 | | 7/2004 |

* cited by examiner

YARN MANUFACTURING APPARATUS AND METHOD

FIELD OF THE INVENTION

The patent or application file contains at least one drawing in color. Copies of this patent or patent application publication with color drawing(s) will be provided by the Office upon request and payment of the necessary fee.

The present invention pertains to the field of continuous synthetic filaments, and particularly, to yarns comprised of multiple continuous filaments. In some embodiments, the present invention pertains to yarns suitable for the production of carpets.

BACKGROUND OF INVENTION

Carpet manufacturers are continually searching for yarns which provide distinct visual appearance when converted into cut, loop pile or cut-loop pile carpet structures. For example, continuous filament carpet yarns which provide an appearance to the final carpet structure showing distinct and separate colors have achieved widespread popularity. The distinct appearance of different colors in the carpet is commonly referred to as "color pop."

One of the main issues with this process is that it is difficult to obtain a good quality yarn with a high degree of color pop. When the air pressure of the entangling jets is sufficient enough to impart substantially uniformly spaced bulked portions and tacks, the colors of the individual yarns may be muted and lose their individual characteristics.

On the other hand, if a high degree of color pop is desired, the air pressure of the entangling jets would be reduced, thereby not allowing the individual yarns to get overly entangled. The resulting color pop turns out to be very good, but the yarns may include a high degree of streaking. Consequently, there is a need for an apparatus and method of manufacturing yarn that reduces streaking while at the same time enhancing color pop.

SUMMARY

The present invention addresses the problems in the art and minimizes streaking when a large denier yarn is tufted into a carpet. Additionally, it provides an apparatus and method of making yarn for carpet that exhibits a high degree of color pop. More specifically, in one aspect, the present invention comprises a yarn manufacturing apparatus and method that comprises supplying a plurality of yarns, false-twist the plurality of yarns, and passing the consolidated yarn through a first entangling assembly to tack at least a portion of the consolidated yarn. In another aspect, the invention comprises passing at least one of the plurality of yarns through one or more second entangling assemblies upstream of the false-twist apparatus.

False-twisting the yarns prior entangling them into a consolidated yarn enhances color pop in the resulting consolidated yarn by changing the order that the yarns are fed into the first entangling assembly. Constantly changing the feed order of the yarns into the first entangling assembly reduces the possibility of one yarn riding on top of the others.

In another embodiment, the yarn manufacturing apparatus comprises a yarn false-twist assembly that has a body member with a first end, an opposed second end, and a central longitudinal axis. One aspect of the body member defines a plurality of second bores that extend longitudinally from the first end to the second end. Each of the second bores are spaced from the central longitudinal axis. In another aspect, the body member defines a central bore that extends longitudinally, co-axial to the central longitudinal axis, therebetween the first and second ends.

In one aspect of the invention, the false-twist assembly has a driver constructed and arranged to rotate the body member in an oscillating fashion so as to impart a false-twist into each yarn being fed into each of the second bores. If yarn is feed through the central bore, then the yarn passing through the second bores are false twisted about the yarn passing through the central bore to form a consolidated yarn.

DETAILED DESCRIPTION OF THE DRAWINGS

The patent or application file contains at least one drawing executed in color. Copies of this patent or patent application publication with color drawing(s) will be provided by the Office upon request and payment of the necessary fee.

These and other features of the preferred embodiments of the present invention will become more apparent in the detailed description in which reference is made to the appended drawings wherein.

DETAILED DESCRIPTION OF THE INVENTION

Figure 1:
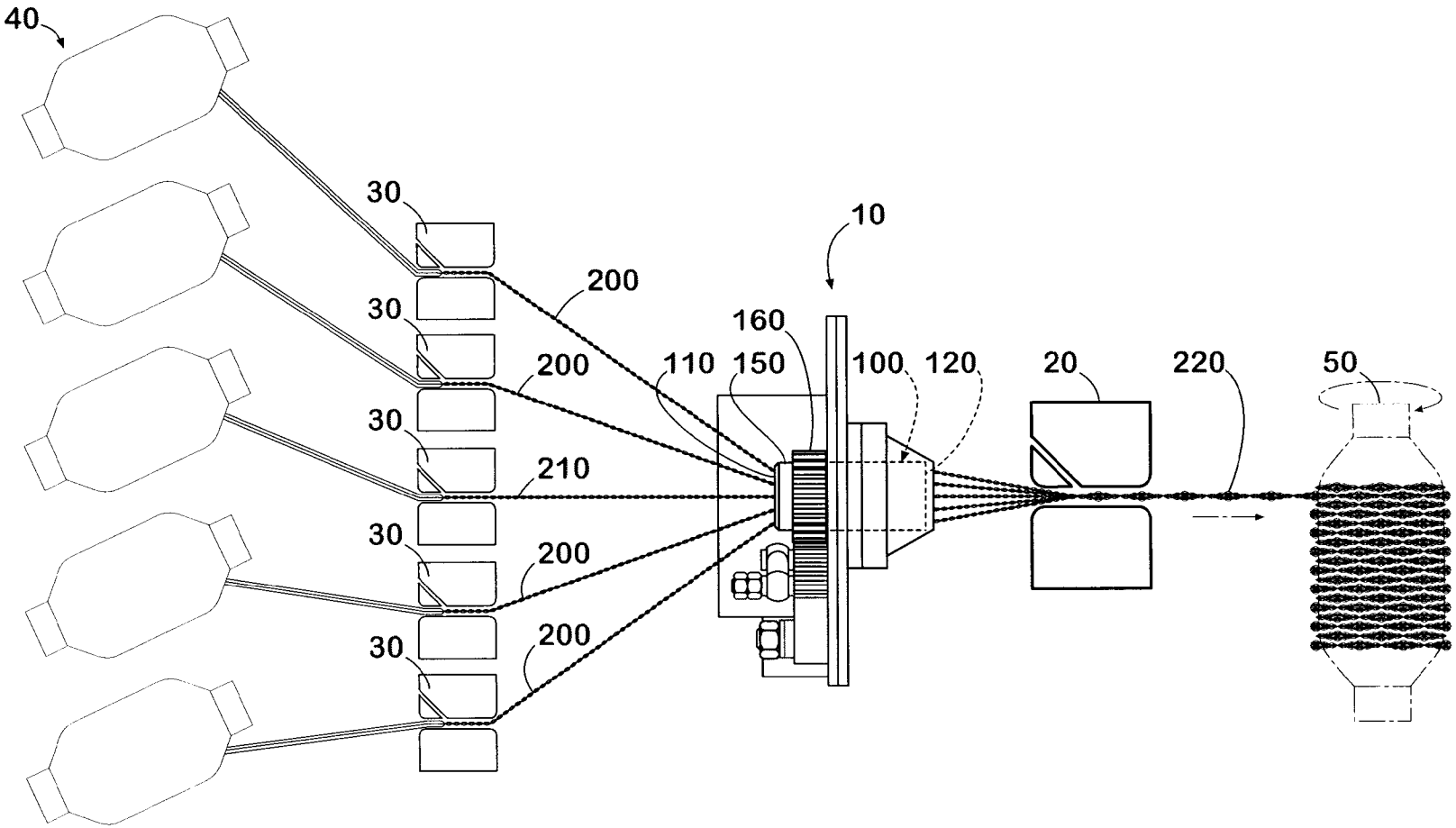
FIG. 1 is a schematic view of one embodiment of a yarn manufacturing apparatus of the present invention showing a false-twist assembly disposed in the flow path between a first entangling assembly and a second entangling assembly.
Figure 3:
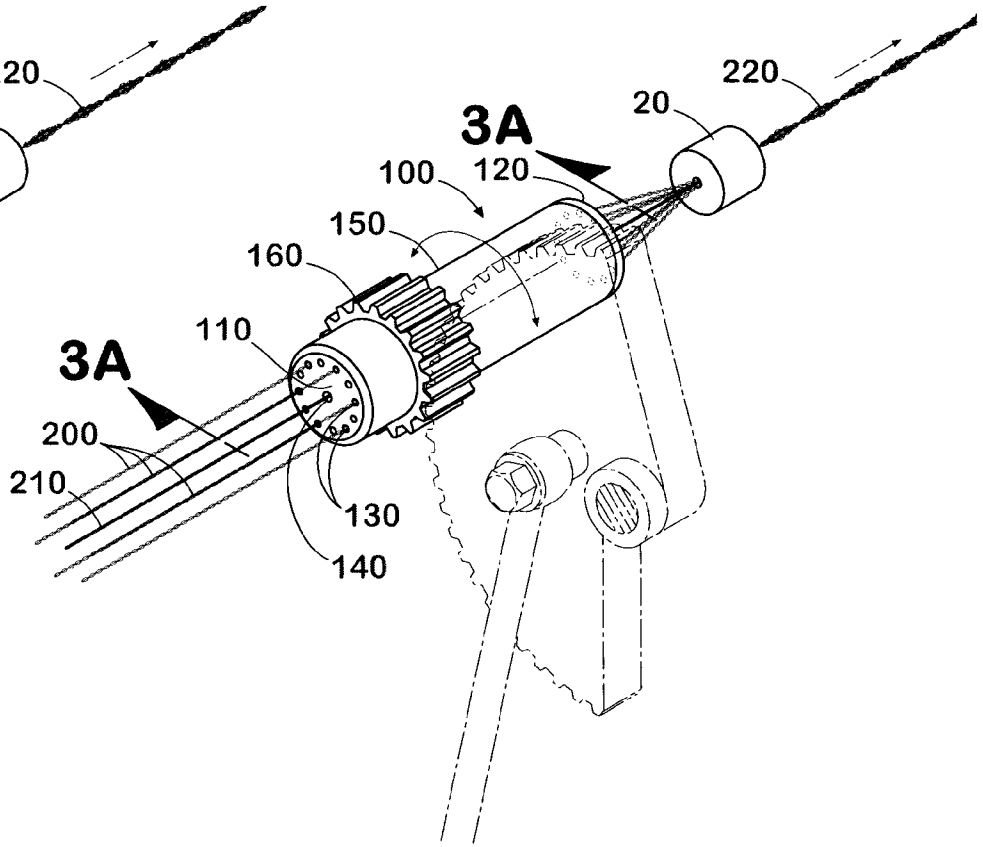
FIG. 3 is a partial perspective view of one aspect of a body member of a false-twist assembly being oscillated about a longitudinal axis by a driver.
Figure 2:
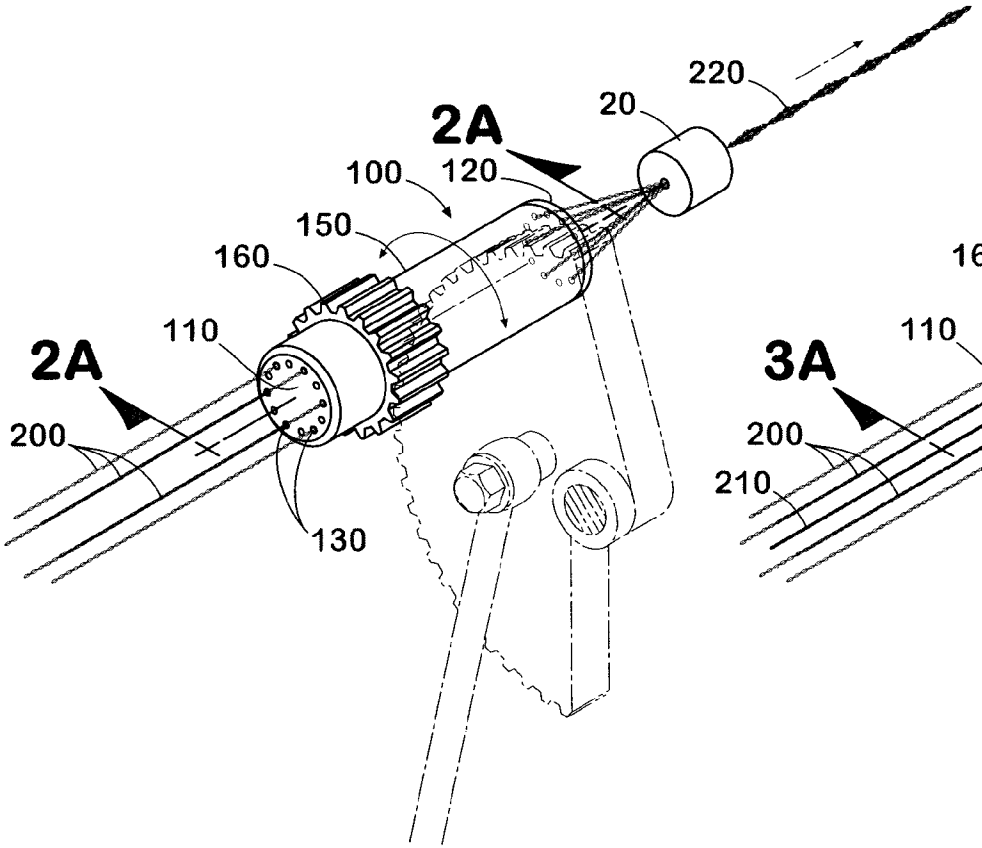
FIG. 2 is a partial perspective view of one aspect of a body member of a false-twist assembly being oscillated about a longitudinal axis by a driver.
Figure 2A:
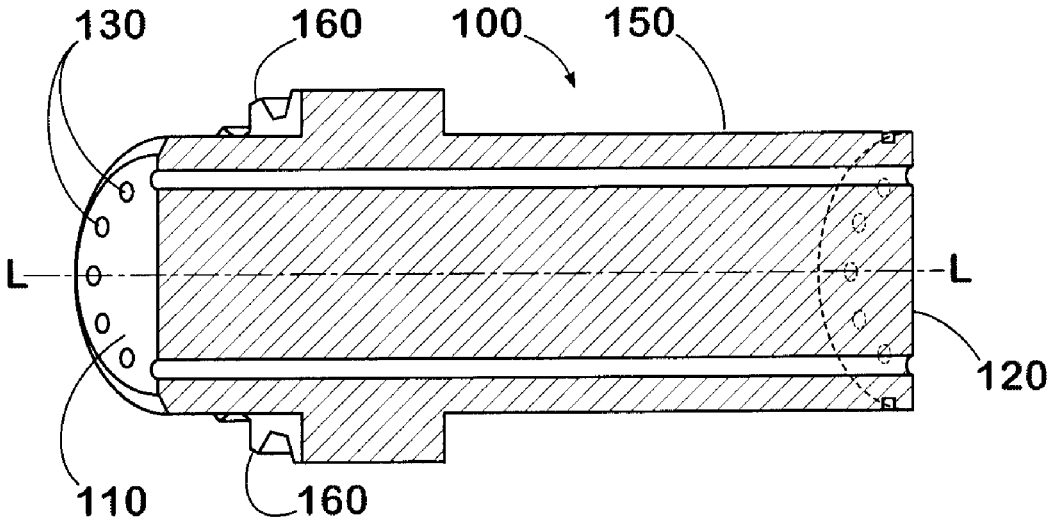
FIG. 2A is a perspective cross-sectional view of the body member taken across line 2A of FIG. 2.
Figure 3A:
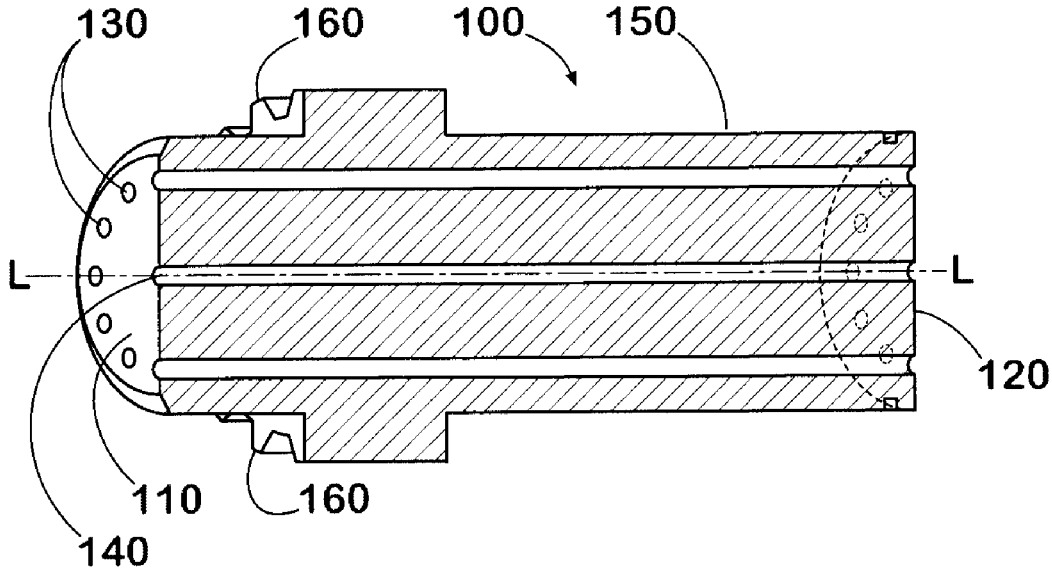
FIG. 3A is a perspective cross-sectional view of the body member taken across line 3A of FIG. 3.

The present invention is more particularly described in the following exemplary embodiments that are intended as illustrative only since numerous modifications and variations therein will be apparent to those skilled in the art. As used herein, "a," "an," or "the" can mean one or more, depending upon the context in which it is used. The preferred embodiments are now described with reference to the figures, in which like reference characters indicate like parts throughout the several views.

Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment.

In one aspect, the present invention provides a continuous yarn manufacturing apparatus and method. In one aspect of the invention, a yarn false-twist assembly 10 is provided that comprises a body member 100 that has a first end 110, an opposed second end 120, and a central longitudinal axis L. The body member 100 of this embodiment defines a plurality of second bores 130 that extend longitudinally substantially parallel to the central longitudinal axis L therebetween the first and second ends. Each of these second bores 130 is spaced from the central longitudinal axis L. In another aspect, the body member can define a central bore 140 that extends longitudinally therebetween the first and second ends substantially co-axial to the central longitudinal axis L. Additionally, in one aspect of this embodiment, the body member 100 is substantially cylindrical.

The false-twist assembly 10 also comprises a means for passing a yarn through each of the second bores 130. If the body member has a central bore 140, the false-twist assembly may also comprise a means for feeding at least one yarn through the central bore of the body member. As one skilled in the art would appreciate, there are a number of conventional means for feeding the yarn through the bores of the body member. It has been contemplated to manually feed the yarn ends through the assembly and to use a mechanical winder 50 to pull the yarns through the false-twist assembly 10. Also, the yarns can be fed using drive rolls (not shown) upstream of the false-twist assembly 10.

In one aspect, there is a pair of drive rolls being driven in a counterclockwise direction. The surface of the drive rolls can be made of a hardened aluminum alloy or the like, and can be slightly textured, but still relatively smooth. In this aspect, the yarn passes from a yarn tensioning device and conventionally around the rolls.

In another aspect, the false-twist assembly 10 comprises a driver constructed and arranged to rotate the body member in an oscillating motion about the central longitudinal axis L of the body member 100 so as to impart a false-twist into each yarn 200 being fed into each of the second bores 130. In one example, the yarns 200 fed into each of the second bores 130 are false-twisted about the yarn or yarns 210 fed through the central bore to form a consolidated yarn 220. As one skilled in the art would appreciate, any conventional driver for rotating the body member about the central longitudinal axis is contemplated. For example, the driver can include, but is not limited to, a drive gear, a drive belt, a direct drive motor, and the like.

In one example, the body member 100 of the false-twist assembly 10 has an exterior peripheral surface 150. In this aspect, the body member has a plurality of gear teeth 160 extending outwardly away from the peripheral surface 150 and about at least a portion of the peripheral surface. In another aspect, the gear teeth 160 extend in a plane substantially normal to the central longitudinal axis L.

In yet another aspect of the false-twist assembly 10, the driver operatively engages the plurality of gear teeth on the exterior peripheral surface of the body member. As one skilled in the art can appreciate, this driver can be, but is not limited to, many common gear assemblies, including spur gears, worm gears, bevel gears, helical gears, rack and pinion gears, and the like.

In one aspect of the false-twist assembly 10, the driver 60 can be a quarter spur gear 62 attached to a cam device. The cam device can, in turn, be attached to a drive motor.

In one aspect of the false-twist assembly 10, the driver oscillates the body member about the central longitudinal axis L in a first direction and a second, opposite, direction from about 45° and about 300° in both directions. In another aspect, the driver oscillates the body member from about 90° and 270° in both directions. In still another aspect, the driver oscillates the body member about 180° in both directions.

The existence of the central bore 140 in the body member 100 of the false-twist assembly 10 makes it possible to false-twist the yarns 200 that are fed through the second bores about the yarn 210 fed through the central bore 140. It will be appreciated that the yarn 210 fed through the central bore 140 receives no false-twist.

In another aspect of the present embodiment, the body member 100 of the false-twist assembly comprises four (4) or less second bores. In yet another aspect, the body member comprises eight (8) or less second bores. Still, in another aspect, the body member comprises twelve (12) or less second bores. One will appreciate however, that any select number of second bores are contemplated.

In another aspect of the present embodiment, the plurality of second bores 130 are spaced from the central longitudinal axis L a predetermined radial distance. In another aspect, each of the plurality of second bores 130 is spaced from the central longitudinal axis L the same predetermined radial distance. It is contemplated however, that the second bores can be positioned at varying distances from the central longitudinal axis. In one example, the second bores are staggered such that adjacent second bores are spaced differing distances from the central longitudinal axis of the body member 100.

One embodiment of the yarn manufacturing apparatus of the present invention comprises a false-twist assembly 10 described above and a first entangling assembly 20. As noted, the false-twist assembly 10 described above can have a central bore 140 that provides the ability to false-twist yarns about a central yarn(s), thereby having a "core" yarn that would be central to the resulting consolidated yarn. However, the present invention will work without the central bore 140. As those skilled in the art could appreciate, any conventional false-twist devices can be used to impart a false-twist in the plurality of yarns. Examples of conventional false-twist devices include false-twist air jets such as those made by Barco, Temco, Belmont, Gilbos and others. Other examples of conventional false-twist devices may include mechanical devices, such as the device depicted in U.S. Pat. No. 4,377,932, which is herein incorporated by reference. As one skilled in the art can appreciate, any device that will impart a false twist into the plurality of yarns will suffice.

In one aspect of the false-twist assembly, the first entangling assembly 20 tacks at least a portion of the consolidated yarn 220 as the consolidated yarn passes therethrough the first entangling assembly 20. The first entangling assembly is positioned downstream of the false-twist assembly. In one example, the first entangling assembly is positioned downstream of the second end 120 of the body member 100. The first entangling assembly can comprise a conventional air tacking jet positioned adjacent and/or along the flow path of the consolidated yarn 220 through the first entangling assembly. In this example, the air tacking jet directs an air stream onto at least a portion of the consolidated yarn. When the yarns emerge from the tacking jet, the yarns have been entangled so that there is a plurality of bulked portions along the yarn, separated by areas in which the yarns are tacked together. Examples of the air tacking jets include jets, such as those made by Barco, Temco, Belmont, Gilbos and others. The first entangling assembly can also comprise, for example and not limited to, a hydro-entangler, a hydraulic entangler, an ultrasonic entangler, or the like.

Another aspect of the yarn manufacturing process further comprises a plurality of second entangling assemblies 30 positioned upstream of the false-twist assembly 10. In one example, each second entangling assembly 30 is positioned upstream of the first end 110 of the body member 100. In this aspect, at least one yarn passes through the plurality of second entangling assemblies 30 prior to the communication of the yarn to the false-twist assembly 10. Each second entangling assembly 30 of the yarn manufacturing process tacks at least a portion of the yarn that passes through the respective second entangling assembly. Similarly to the first entangling assembly, the second entangling assemblies 30 can comprise an air tacking jet positioned adjacent and/or along a flow path of the yarn through the second entangling assembly. In this aspect, the air tacking jet directs an air stream onto at least a portion of the yarn. Examples of the air tacking jets include jets, such as those made by Barco, Temco, Belmont, Gilbos and others. The second entangling assemblies can also comprise, for example and not limited to, a hydro-entangler, a hydraulic entangler, an ultrasonic entangler, or the like.

In another aspect of the yarn manufacturing apparatus of this embodiment, the yarns 200 comprise at least two colors. In yet another aspect, in which the false-twist assembly defines a central bore 140 and a plurality of second bores 130, at least one of the yarns of the at least one yarn 210 fed into the central bore has a different color than the color of the yarn 200 fed into the second bores.

Another embodiment of the invention is a method of manufacturing yarn comprising supplying a plurality of yarns. Generally, the yarns are fed to the process from a creel 40, from one or more knit socks, or from any other means known in the art. In one example, the supplied yarns pass through appropriate guide means (not shown), then to a tensioning means (not shown). The tensioning means can be a pair of disks, one disk being urged towards the other by spring means so that the variation of spring tension will vary the tension on the yarns. Such a tensioning device is well known to those skilled in the art. Any tensioning means known to those skilled in the art would be appropriate.

The supplied yarn is then fed into a false-twist assembly 10. As mentioned previously, the false-twist assembly can be identical to the false-twist assembly described herein above (with or without the central bore), or it can be any of a number of false twisting assemblies known in the art. The false-twist assembly described above, with the second bores 130 and the central bore 140 defined in the body member 100, provides the ability to false-twist yarns about a central yarn 210, which would be substantially at the core of the resulting consolidated yarn.

Next, the plurality of yarns are false-twisted. In an aspect of this embodiment, in which the false-twist assembly defines the plurality of second bores and the central bore, the method comprises feeding a yarn through each of at least two of the second bores of the body member of the false-twist assembly and feeding at least one yarn through the central bore of the body member. The body member 100 of the false-twist assembly 10 is rotated in an oscillating motion so as to impart the false-twist into each yarn 200 being fed into each of the at least two second bores 130 about at least one yarn 210 fed through the central bore 140 to form a consolidated yarn 220. In one aspect, at least one yarn fed into the central bore can have a different color than the color of the yarn fed into the second bores.

In one aspect of the method, the yarn passing through the central bore is from about 5% to about 95%, by weight, of the formed consolidated yarn. In another aspect, the yarn passing through the central bore is from about 15% to about 80%, by weight, of the formed consolidated yarn. In yet another aspect, the yarn passing through the central bore is from about 25% to about 60%, by weight, of the formed consolidated yarn.

In an alternative aspect, in which the false-twist assembly 10 described above has a plurality of bores 130 and no central bore, the method comprises feeding a yarn through at least two of the bores of the body member of the false-twist assembly. The method further comprises rotating the body member of the false-twist assembly in an oscillating motion so as to impart a false twist into each yarn being fed into each of the at least two bores to form a consolidated yarn 220.

False-twist a multi-colored yarn prior to entangling enhances color pop in a resulting carpet made from such yarn by alternating the sequence of the respective colors going through the entangling process, thereby disallowing one particular color from riding on top of the other color(s) in the consolidated yarn.

In one example of this method, after forming the consolidated yarn, the yarn is passed through a first entangling assembly 20 to tack at least a portion of the consolidated yarn 220. As mentioned above, tacking the consolidated yarns forms a plurality of bulked portions along the yarn, separated by areas in which the yarns are tacked together.

In one aspect of this method, the method further comprises, after supplying a plurality of yarns, passing at least one yarn of the plurality of yarns through one or more second, upstream, entangling assemblies 30 to tack at least a portion of the yarn. As can be appreciated by one skilled in the art, all of the plurality yarns can be passed through second entangling assemblies. That is, each yarn can pass through its own particularly assigned second entangling assembly.

Tacking the individual yarns prior to subjecting them to a false-twist step assists in keeping the filaments of the individual yarns together. In this way, the separate yarns retain their individual characteristics when formed into a consolidated yarn. This is especially noticeable when the plurality of yarns comprises at least two colors.

In one aspect of the method, each yarn of the plurality of yarns has a denier of from about 150 and 9,000. In yet another aspect, the consolidated yarn passing out of the first, downstream, entangling assembly has a denier of from about 300 and 15,000. These ranges are approximate and are not to be considered a limitation to the method of manufacturing yarn herein described.

In another aspect of this embodiment, the method includes winding up the consolidated yarn for future use. The consolidated yarn can then be used in the manufacture of a variety of carpet types.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A yarn manufacturing apparatus, comprising:

a) a false-twist assembly, comprising:

i) a body member having a first end, an opposed second end, and a central longitudinal axis, the body member defining a plurality of bores extending parallel to the central longitudinal axis therebetween the first and second ends, each bore being spaced from the central longitudinal axis; and ii) a driver constructed and arranged to rotate the body member in an oscillating motion so as to impart a false-twist into each yarn being passed into each of at least two bores of the plurality of bores to form a consolidated yarn;

b) a first entangling assembly positioned substantially adjacent and downstream of the false twist assembly to tack at least a portion of the consolidated yarn as the consolidated yarn passes therethrough the first entangling assembly, the first entangling assembly being positioned downstream of the second end of the body member; and c) at least one second entangling assembly positioned upstream of the first end of the body member, at least one yarn passing through the second entangling assembly prior to the communication of the at least one yarn to the body member to tack at least a portion of the yarn that passes therethrough the second entangling assembly.

2. The yarn manufacturing apparatus of claim 1, further comprising means for feeding a yarn through each of at least two of the bores of the body member.

3. The yarn manufacturing apparatus of claim 1, wherein the driver oscillates the body member about the central longitudinal axis in a first direction and an opposite second direction, and wherein the body member rotates from about 45° to about 300° in both the first and second directions.

4. The yarn manufacturing apparatus of claim 1, wherein the driver oscillates the body member about the central longitudinal axis in a first direction and an opposite second direction, and wherein the body member rotates from about 90° to about 270° in both the first and second directions.

5. The yarn manufacturing apparatus of claim 1, wherein the driver oscillates the body member about the central longitudinal axis in a first direction and an opposite second direction, and wherein the body member rotates about 180° in both the first and second directions.

6. The yarn manufacturing apparatus of claim 1, wherein each of the plurality of bores is spaced from the central longitudinal axis a predetermined radial distance.

7. The yarn manufacturing apparatus of claim 6, wherein each of the plurality of bores is spaced from the central longitudinal axis substantially the same radial distance.

8. The yarn manufacturing apparatus of claim 1, wherein the first entangling assembly comprises an air tacking jet positioned adjacent a flow path of the consolidated yarn through the first entangling assembly, and wherein the air tacking jet directs an air stream onto at least a portion of the consolidated yarn.

9. The yarn manufacturing apparatus of claim 1, wherein the second entangling assembly comprises an air tacking jet positioned adjacent a flow path of the yarn through the second entangling assembly, and wherein the air tacking jet directs an air stream onto at least a portion of the yarn.

10. The yarn manufacturing apparatus of claim 1, wherein the yarns comprise at least two colors.

11. A method of manufacturing yarn, comprising:

supplying a plurality of yarns;

passing at least one yarn of the plurality of yarns through one of a plurality of second entangling assemblies to tack at least a portion of the yarn;

providing a false-twist assembly, comprising a body member having a first end, an opposed second end, and a central longitudinal axis, the body member defining a plurality of bores extending parallel to the central longitudinal axis therebetween the first and second ends, each bore being spaced from the central longitudinal axis;

rotating the body member in an oscillating motion so as to impart a false-twist into each yarn being passed through each of at least two bores to form a consolidated yarn; and passing the consolidated yarn through a first entangling assembly to tack at least a portion of the consolidated yarn immediately subsequent the step of forming the consolidated yarn.

12. The method of claim 11, further comprising winding up the consolidated yarn.

13. The method of claim 11, wherein each second entangling assembly of the plurality of second entangling assemblies tacks one individual yarn of the plurality of yarns.

14. The method of claim 11, wherein all of the plurality of yarns pass through the false-twist assembly.

15. The method of claim 11, wherein the plurality of yarns comprise at least two colors.

16. The method of claim 11, wherein each of the plurality of yarns have a denier of from about 150 to about 9000.

17. The method of claim 11, wherein the consolidated yarn has a denier of from about 300 to about 15,000.

18. A method of manufacturing yarn, comprising:

supplying a plurality of yarns;

passing at least one yarn of the plurality of yarns through one of a plurality of second entangling assemblies to tack at least a portion of the yarn prior to the false twist step;

false-twisting the plurality of yarns to form a consolidated yarn; and passing the consolidated yarn through a first entangling assembly to tack at least a portion of the consolidated yarn immediately subsequent the false twist step.

19. The method of claim 18, further comprising winding up the consolidated yarn.

20. The method of claim 18, wherein each second entangling assembly of the plurality of second entangling assemblies tacks one individual yarn of the plurality of yarns.

21. The method of claim 18, wherein the plurality of yarns comprise at least two colors.

22. The method of claim 18, wherein each of the plurality of yarns have a denier of from about 150 to about 9000.

23. The method of claim 18, wherein the consolidated yarn has a denier of from about 300 to about 15,000.

* * * * *